US007143961B1

(12) United States Patent
Wu et al.

(10) Patent No.: US 7,143,961 B1
(45) Date of Patent: Dec. 5, 2006

(54) CONTROL SYSTEM FOR CHANGING WATER FLOW BETWEEN TWO SHOWER HEADS

(76) Inventors: James Wu, NO1, Alley 16, Lane 40, Jinde Rd., East District, Taichung City 40141 (TW); Alex Wu, NO1, Alley 16, Lane 40, Jinde Rd., East District, Taichung City 40141 (TW); Harry Guan, NO1, Alley 16, Lane 40, Jinde Rd., East Dictrict, Taichung City 40141 (TW)

( * ) Notice: Subject to any disclaimer, the term of this patent is extended or adjusted under 35 U.S.C. 154(b) by 0 days.

(21) Appl. No.: 11/414,452

(22) Filed: Apr. 27, 2006

(51) Int. Cl.
*A62C 31/00* (2006.01)

(52) U.S. Cl. ..... 239/446; 239/447; 239/443; 239/569; 239/436; 4/567; 4/605; 4/615

(58) Field of Classification Search ..... 239/436, 239/443, 444, 446, 445, 447, 317, 569; 4/567, 4/676, 677, 605, 615; D23/213
See application file for complete search history.

(56) References Cited

U.S. PATENT DOCUMENTS 3,112,073 A * 11/1963 Larson et al. ..... 239/446
4,203,551 A * 5/1980 Levine ..... 239/381
5,823,441 A * 10/1998 Nicholson ..... 239/317
6,142,389 A * 11/2000 Kynett ..... 239/447

* cited by examiner

*Primary Examiner*—Dinh Q. Nguyen
(74) *Attorney, Agent, or Firm*—Pro-Techtor Int'l Services

(57) ABSTRACT

A shower head assembly includes a first shower head connected to a pipe and a three-way member is connected to the pipe. The three-way member communicates with the pipe, the first shower head and a hose which is connected to a second shower head. A tube is fixedly received in the three-way member and in communication between two paths respectively which are in communication with the first shower head and the hose. A rod is movably inserted in the tube and has two seal members on two ends thereof. A control mechanism is connected to the handle of the second shower head and able to cause the change of water pressure to move the rod such that the user can operate the control mechanism on the handle of the second shower head to control the water flow.

2 Claims, 5 Drawing Sheets

CONTROL SYSTEM FOR CHANGING WATER FLOW BETWEEN TWO SHOWER HEADS

FIELD OF THE INVENTION

The present invention relates to a control system for changing water flow between a fixed shower head and a movable shower head.

BACKGROUND OF THE INVENTION

A conventional shower head used in bath rooms generally is fixed on a wall or is connected with a hose which is connected to the faucet. The fixed shower head can be pivoted on a ball-type joint and the users do not need to carry the shower head. The movable shower head includes a handle which is connected with a hose so that the user holds the handle and move the shower head to a desired position. However, each of the fixed shower head and the movable shower head has its inherent shortcomings, so that there is a combination developed in the market. The combination includes a valve connected on the faucet and the users can operate the valve to change the water flow between the fixed shower head and the movable shower head. Nevertheless, the valve is located at a lower position so that the users have to bend to operate the valve, and this is not convenient for some users.

The present invention intends to provide a control system for changing water flow between the fixed shower head and the movable shower head, the system includes a control lever located on the handle of the movable shower head so that the users can easily operate the system.

SUMMARY OF THE INVENTION

The present invention relates to a shower head assembly includes a first shower head connected to a pipe and a three-way member of a control system is connected to the pipe. The three-way member includes a first open end, a second open end and a third open end, wherein the first open end is mounted to the pipe and the second open ends is connected to the first shower head. A first end of a hose is connected to the third open end and a second end of the hose is connected to a handle of a second shower head. A tube is fixedly received in the three-way member and has a passage defined therein. A first path is defined in communication with the first open end and the third open end, a second path is defined in communicating with the second open end and the passage. A rod is received in the tube and movably extends through the passage. A first end of the rod has a first seal member and a second seal member is connected to a second end of the rod. The second seal member seals an end of the tube communicating the third open end of the three-way member, and the first seal member removably seals the passage when the rod moves in the tube. A control mechanism is connected to the handle of the second shower head and has a block member which is rotatably received in a through path in the handle. The block member includes side wings which are rotated with the block member to seal or open the through path. A control lever is located outside of the handle and has an insertion which is secured engaged with a through hole of the block member.

The primary object of the present invention is to provide a shower head assembly which includes a fixed shower head and a movable shower head, a control mechanism is connected to the handle of the movable shower head so as to easily control the water flow to the fixed shower head or the movable shower head.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
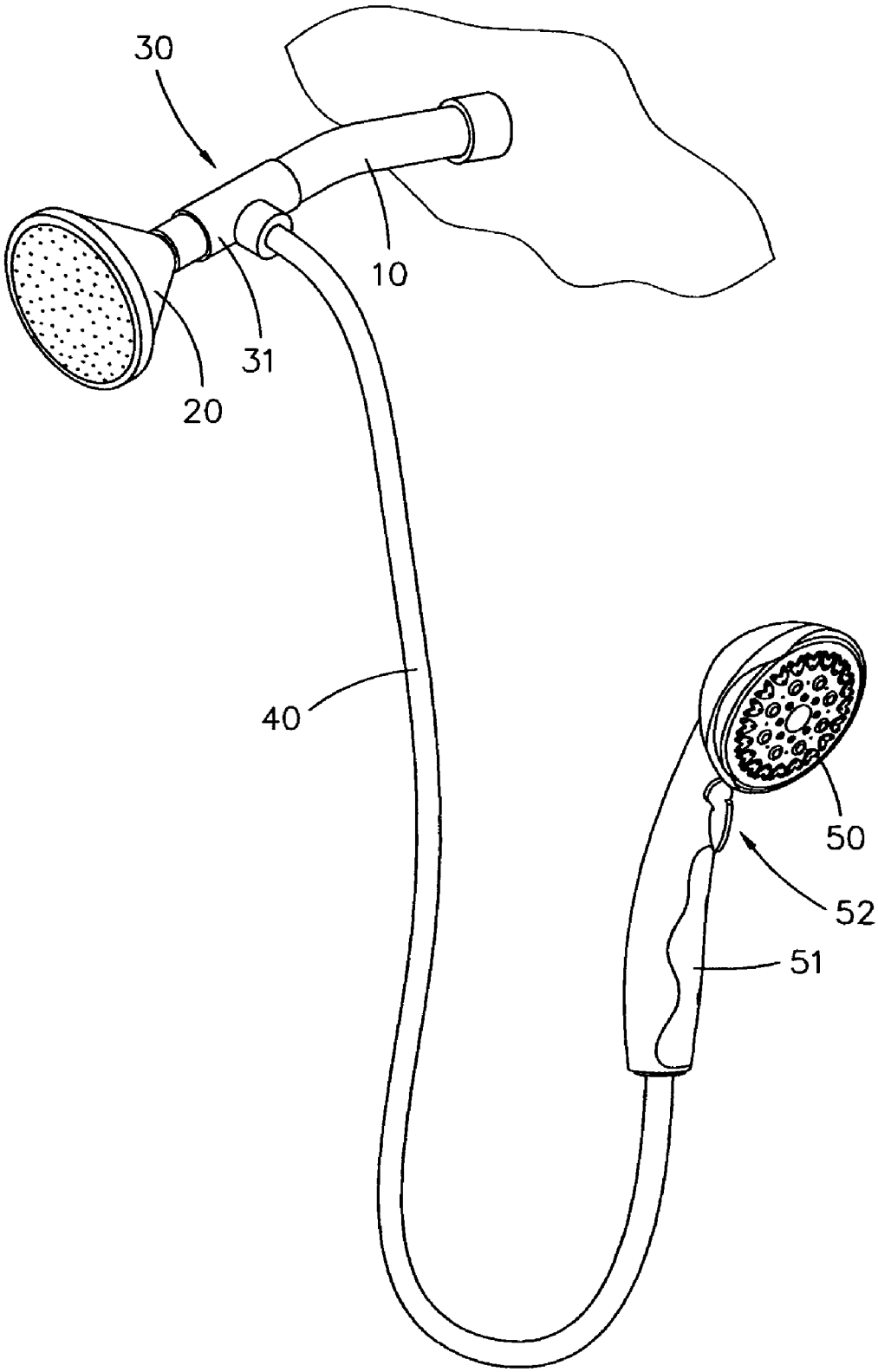
FIG. 1 is a perspective view to show the shower head assembly of the present invention.
Figure 2:
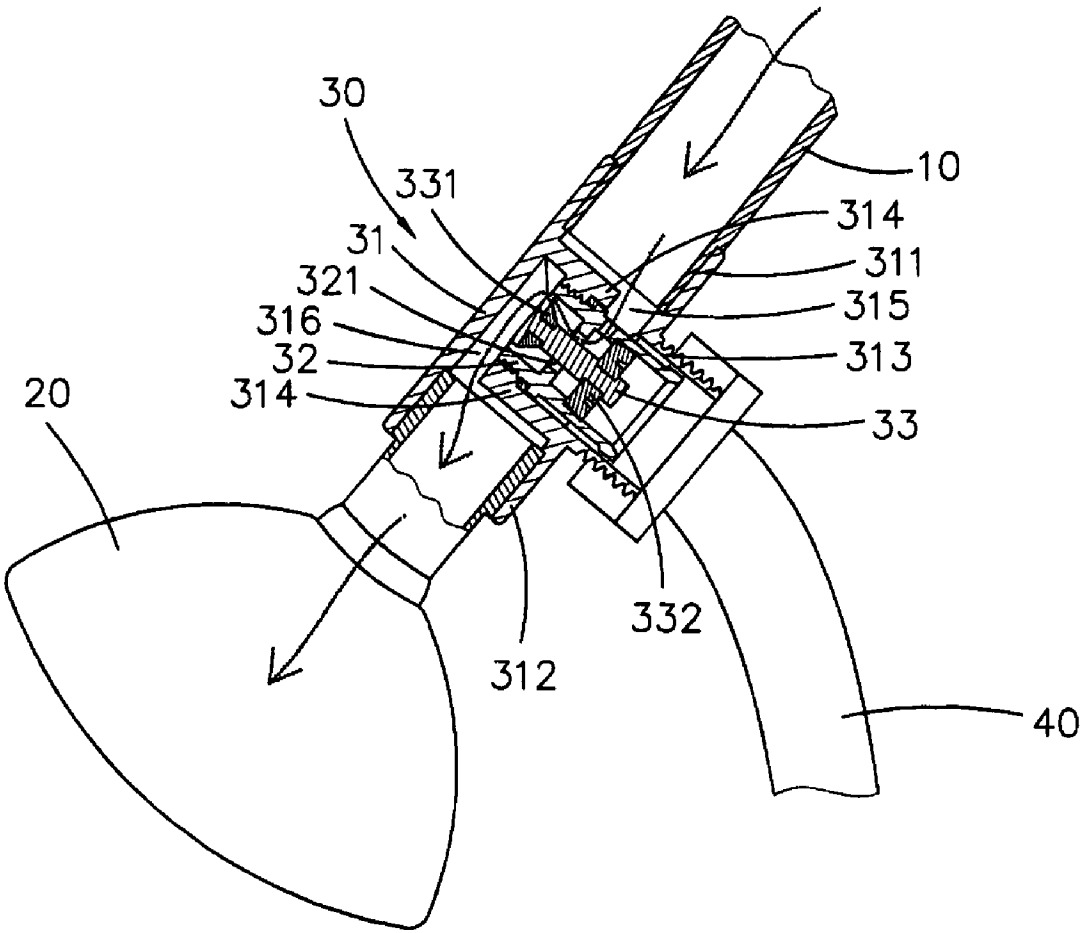
FIG. 2 is a cross sectional view to show that water flows out from the first shower head.
Figure 3:
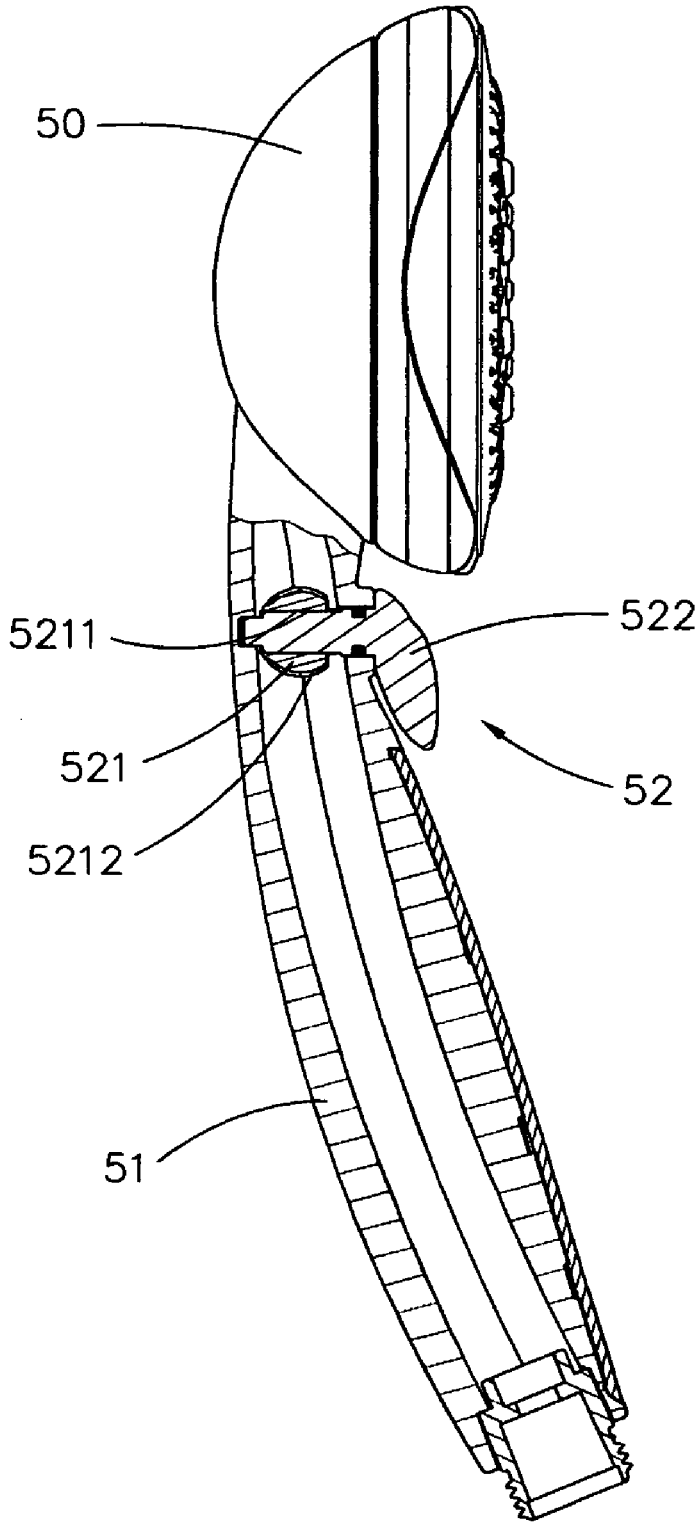
FIG. 3 is a cross sectional view to show the control mechanism connected to the handle of the second shower head.

Referring to FIGS. 1 to 3, the shower head assembly comprises a first shower head 20 connected with a pipe 10 extending from a wall and a control system 30 is connected to the h\pipe 10. The control system 30 includes a three-way member 31 connected to the pipe 10 and the three-way member 31 includes a first open end 311, a second open end 312 and a third open end 313. The first open end 311 is mounted to the pipe 10 and the second open end 312 is connected to the first shower head 20. A first end of a hose 40 is connected to the third open end 313 and a second end of the hose 40 is connected to a handle 51 to which a second shower head 50 is connected.

Two connection plates 314 extend radially inward from an inner periphery of the three-way member 31 and the two connection plates 314 extend in opposite directions. The tube 32 is fixedly connected between the two connection plates 314 and a transverse plate is connected in the tube 32. The transverse plate separates the interior in the tube 32 into an upper chamber and a lower chamber. A passage 321 is defined through the transverse plate. An aperture 320 is defined through a wall of the tube 32 and in communication between a first path 315 defined between one of the connection plates 314 and the inner periphery of the three-way member 31, and the lower chamber of the interior in the tube 32.

A second path 316 is defined between the other connection plate 314 and the inner periphery of the three-way member 31. The second path 316 is in communicating with the second open end 312 and the upper chamber in the tube 32. A rod 33 is received in the tube 32 and movably extends through the passage 321. A first end of the rod 33 has a first seal member 331 and a second seal member 332 is connected to a second end of the rod 33. The second seal member 332 seals the lower chamber when the rod 33 is located at an upper position. The first seal member 331 removably seals the passage 321 when the rod 33 moves to a lower position in the tube 32.

A control mechanism 52 is connected to the handle 51 of the second shower head 50 and has a block member 521 which is rotatably received in a through path in the handle 51. The block member 521 includes side wings 5212 which are rotated with the block member 521 to seal or open the through path. A control lever 522 is located outside of the handle 51 and has an insertion which is secured engaged with a through hole 5211 of the block member 521.

As shown in FIG. 2, when the rod 33 is located at the upper position, the control mechanism 52 is in sealed position so that the pressure pushes the rod 33 upward and the second seal member 332 seals the lower chamber. Water coming from the pipe 10 passes through the first path 315, the aperture 320, the lower chamber, the passage 321, the upper chamber and the second path 316 so as to flow out from the first shower head 20.

Figure 4:
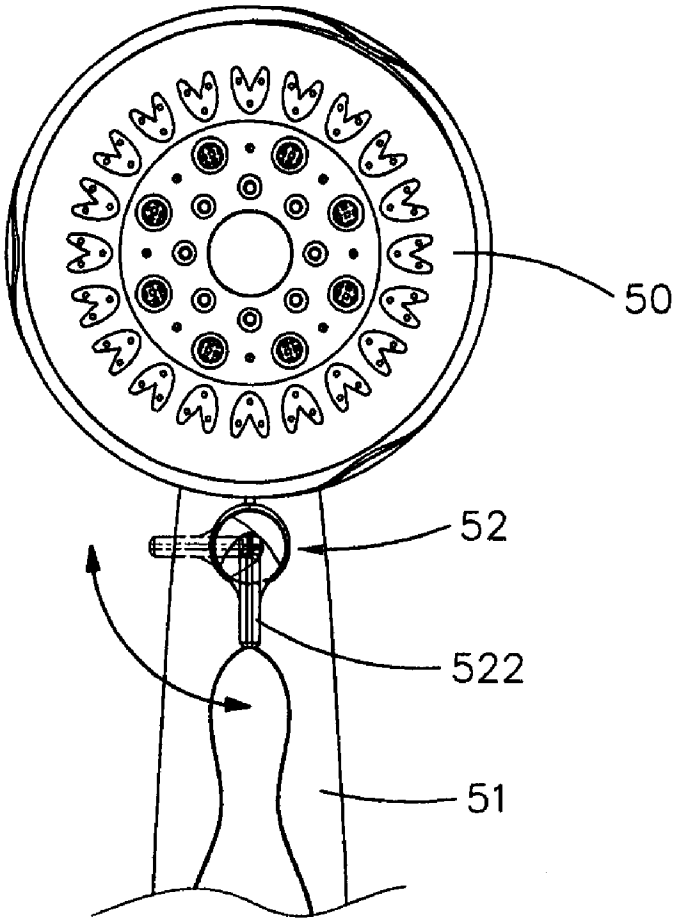
FIG. 4 shows that the control lever is pivoted.
Figure 5:
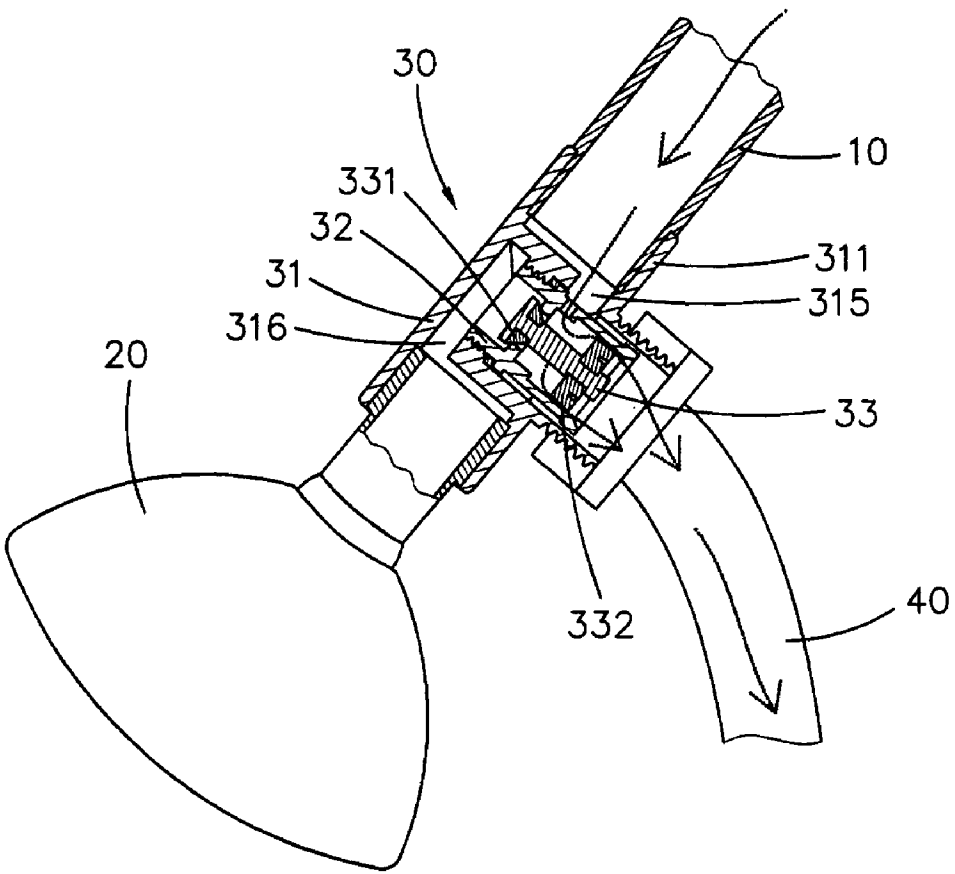
FIG. 5 shows that water flows out from the second shower head.

As shown in FIGS. 4 and 5, when the control lever 522 is pivoted to rotate the block member 521 to open the through path in the handle 51, the water pressure pushes the second seal member 332 downward which is removed from the stepped shoulder in the tube 32 so that the lower chamber is opened, and the passage 321 is sealed by the first seal member 331, so that water passes through the gap between the second seal member 332 and the inner periphery of the tube 32 and flows out from the second shower head 50.

While we have shown and described the embodiment in accordance with the present invention, it should be clear to those skilled in the art that further embodiments may be made without departing from the scope of the present invention.

What is claimed is:

1. A shower head assembly comprising:

a first shower head connected to a pipe;

a control system including a three-way member connected to the pipe and the three-way member including a first open end, a second open end and a third open end, the first open end mounted to the pipe and the second open end connected to the first shower head, a first end of a hose connected to the third open end and a second end of the hose connected to a handle of a second shower head, a tube fixedly received in the three-way member and having a transverse plate connected therein, the transverse plate separating an interior in the tube into an upper chamber and a lower chamber, a passage defined through the transverse plate and an aperture defined through a wall of the tube, the aperture being in communication between the first open end and the lower chamber of the interior in the tube, the second open end being in communicating with the upper chamber in the tube;

a rod received in the tube and movably extends through the passage, a first end of the rod having a first seal member and a second end of the rod connected with a second seal member, the second seal member removably sealing the lower chamber when the rod is located at an upper position, the first seal member removably sealing the passage when the rod moves to a lower position in the tube, and a control mechanism connected to the handle of the second shower head and having a block member which is rotatably received in a through path in the handle, the block member including side wings which are rotated with the block member to seal or open the through path, a control lever located outside of the handle and having an insertion which is secured engaged with a through hole of the block member.

2. The assembly as claimed in claim 1, wherein two connection plates extend radially inward from an inner periphery of the three-way member and the two connection plates extend in opposite directions, the tube is fixedly connected between the two connection plates, the aperture is in communication with a first path which is defined between a distal end of one of the two connection plates and the inner periphery of the three-way member, a second path is defined between a distal end of the other connection plate and the inner periphery of the three-way member, the first path communicates with the first open end and the second path communicates with the second open end.

* * * * *